US005857131A

United States Patent [19]

Hasegawa

[11] Patent Number: 5,857,131

[45] Date of Patent: Jan. 5, 1999

[54] IMAGE FORMING CONDITION CONTROL DEVICE AND METHOD FOR AN IMAGE FORMING APPARATUS

[75] Inventor: Shin Hasegawa, Chiba, Japan

[73] Assignee: Ricoh Company, Ltd., Tokyo, Japan

[21] Appl. No.: 967,608

[22] Filed: Nov. 10, 1997

[30] Foreign Application Priority Data

Nov. 8, 1996 [JP] Japan ..... 8-296039

[51] Int. Cl.[6] ..... G03G 15/00

[52] U.S. Cl. ..... 399/46; 399/43

[58] Field of Search ..... 399/1, 37, 38, 399/43, 46, 48, 50, 53, 67, 88, 100

[56] References Cited

U.S. PATENT DOCUMENTS

| | | | |
|---|---|---|---|
| 4,380,386 | 4/1983 | Yasuda et al. | 399/43 |
| 5,107,279 | 4/1992 | Yamamoto et al. | 399/1 X |
| 5,182,600 | 1/1993 | Hasegawa et al. . | |
| 5,198,861 | 3/1993 | Hasegawa et al. . | |
| 5,327,196 | 7/1994 | Kato et al. . | |
| 5,387,965 | 2/1995 | Hasegawa et al. . | |
| 5,459,554 | 10/1995 | Shiraishi | 399/43 |
| 5,485,255 | 1/1996 | Reuschle et al. | 399/100 X |
| 5,694,637 | 12/1997 | Yoshino et al. | 399/38 |
| 5,701,547 | 12/1997 | Yamada et al. | 399/1 |

FOREIGN PATENT DOCUMENTS

| | | |
|---|---|---|
| 3-92876 | 4/1991 | Japan . |
| 4-60653 | 2/1992 | Japan . |
| 5-45982 | 2/1993 | Japan . |
| 5-224495 | 9/1993 | Japan . |

*Primary Examiner*—Sandra Brase
*Attorney, Agent, or Firm*—Oblon, Spivak, McClelland, Maier & Neustadt, P.C.

[57] ABSTRACT

An image forming method and apparatus includes a plurality of processing devices for forming an image on a sheet of paper. When a power source switch is turned on, electric power is supplied to the apparatus and a timer begins to count. If the power source switch is turned on, a controller preconditions an adjustment of the processing devices on a temperature of a fixing roller being not more than a predetermined temperature. Further, if the timer counts for a predetermined amount of time, say 24 hours, the condition of the processing devices is also adjusted.

22 Claims, 3 Drawing Sheets

IMAGE FORMING CONDITION CONTROL DEVICE AND METHOD FOR AN IMAGE FORMING APPARATUS

BACKGROUND OF THE INVENTION

1. Field of the Invention

The present invention relates to an image forming apparatus such as a copier, a printer, a facsimile machine or similar image forming apparatus, and methods used therein, in which images are formed and in which a quality of the images are controlled. More particularly, the invention relates to an image forming condition controlling method and device for use in the image forming apparatus.

2. Discussion of Background

For a conventional image forming apparatus, adjustments are often made to alter the performance conditions of selected processing devices, such as a photoconductive drum, a charger, an exposing unit, a developing device, a transfer device and so on, so as to maintain an acceptable image quality. The adjustment is often necessitated by the photoconductive drum or developer, for example, changing their characteristic performance conditions as a result of aging, repeated use, and operating environment.

In order to adjust the condition of such processing devices, an operation of the respective processing devices is controlled in response to a detected surface voltage of the photoconductive drum and a detected toner density. The adjustment is conventionally performed during a warm-up interval, after a power source switch for the image forming apparatus is turned on.

For example, Japanese Laid-open patent No. 5-45982 describes an image forming condition control device in which the adjustments are performed when the power source switch is turned on and temperature of a fixing roller is not more than a predetermined temperature.

However, as recognized by the present inventor, if the power source switch remains on for more than 24 hours, a considerable performance degradation may be experienced. Because an image condition correction event (i.e. a toggling of the power switch) had not been performed during this interval, the condition of the image forming components continues to degrade to perhaps unsatisfactory levels, which in turn causes the image quality to become increasingly poor.

SUMMARY OF THE INVENTION

Accordingly, it is an object of the present invention to provide a novel image forming condition control method and device for an image forming apparatus that overcomes the above-identified, and other, problems and limitations of conventional devices.

It is another object of the present invention is to provide an image forming condition control method and device where the image forming apparatus maintains good image quality, i.e. within an acceptable range, while the apparatus remains in an operational state for an extended period of time.

In order to achieve the above-mentioned and other objects, according to the present invention, an image forming method and apparatus includes a plurality of processing devices that cooperate to form an image on a sheet of paper, or other image holding member. These processing devices include a power source for supplying electric power to the apparatus when the power source is turned on, a timer which starts to keep track of time relative to when the power source was turned on (or other time setting), and a control circuit that controls a condition adjustment operation on at least one of the processing devices such that the adjustment operation starts when the power source is turned on or when the time kept by the timer reaches a predetermined count value.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
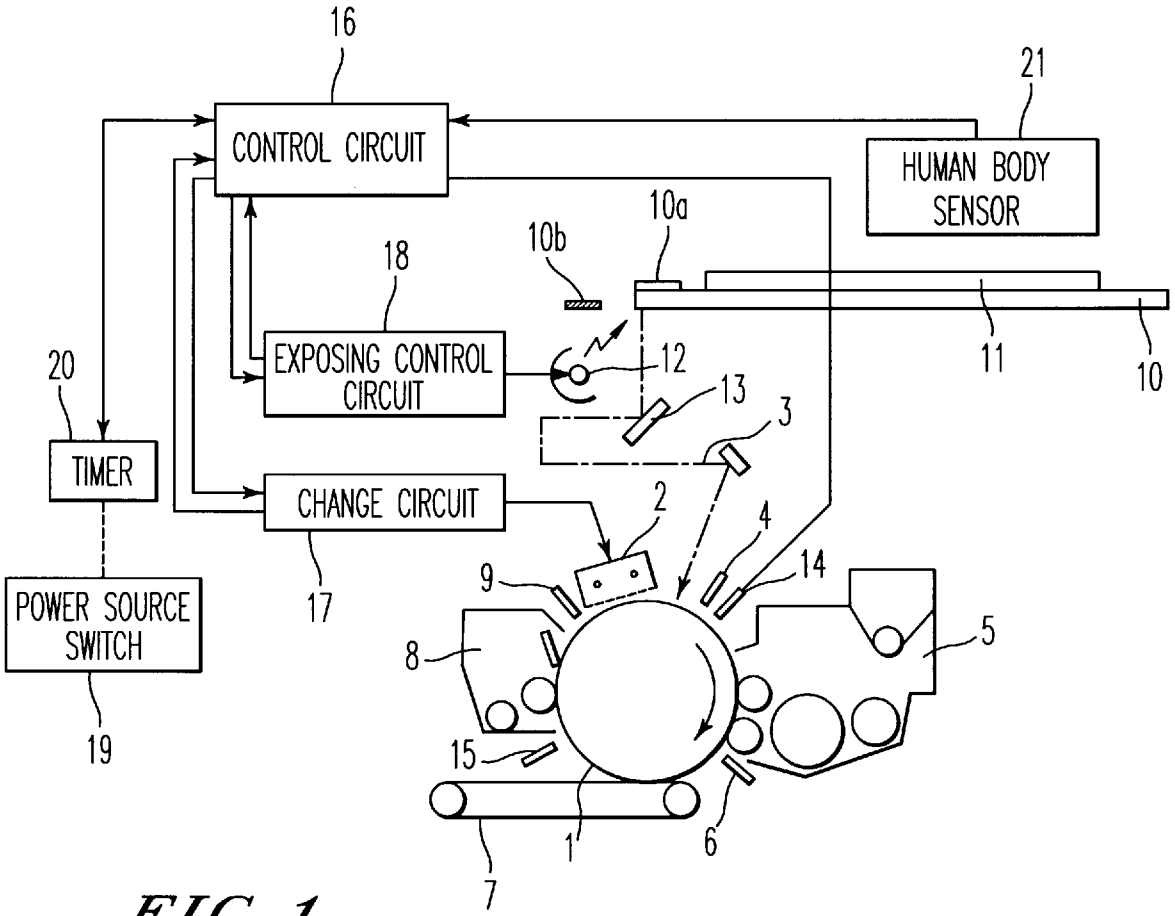
FIG. 1 is a schematic sectional view showing an image forming apparatus embodying the present invention.

Referring now to the drawings, wherein like reference numerals designate identical or corresponding parts throughout the several views, and more particularly to FIG. 1 thereof, a copier is illustrated.

In the copier, a photoconductive drum 1 is shown with an associated plurality of processing devices such as a charger 2, an exposing unit 3, an eraser 4, a developing device 5, a pre-transfer discharging lamp 6, a transfer device 7, a cleaning device 8 and a discharging lamp 9. The exposing unit 3 includes an exposing lamp 12, mirrors 13 and lens for projecting on the photoconductive drum 1 a reflected light from a document 11, positioned on a platen glass 10. A standard white plate 10*a* and a standard black plate 10*b* are provided outside of the platen glass 10, as shown.

The copier also includes, although not expressly shown, a paper feeder for feeding a sheet of paper (or other image holding member such as a transparency), a paper transporting unit, and a fixing device including a fixing roller in which a heater is provided and a pressure roller. An operation panel, serving as a user interface, includes a keypad that allows an operator to input commands to the copier and a display for displaying prompts to the user and displaying other messages. A surface voltage sensor 14 is included to detect a surface voltage of the photoconductive drum 1 and is provided at a downstream location of the eraser 4 with respect to a rotating direction of the photoconductive drum 1. Further, a photo sensor 15 is provided at a downstream of the transfer device 7 with respect to a rotating direction of the photoconductive drum 1. The photo sensor 15 detects reflected light from a background of the photoconductive drum 1 and from toner images corresponding the standard white plate 10*a* and the standard black plate 10*b*.

In operation, the charger 2 charges the surface of the photoconductive drum 1 uniformly. The reflected light from the document 11 then irradiates the photoconductive drum 1, while unnecessary voltage on the photoconductive drum 1 is erased by the eraser 4, so that an electrostatic latent image corresponding to the image of the document is formed on the photoconductive drum 1. The electrostatic latent image is developed by the developing device 5 with an image forming substance so as to form a toner image.

The toner image is subsequently transferred to the sheet of paper which is fed from the paper feeder via the paper transport unit. The toner image on the sheet of paper is fixed by the fixing device and then discharged to an output tray. Residual toner on the photoconductive drum 1 is cleaned by the cleaning device 8 and a residual voltage is discharged by the discharging lamp 9. Additional operations may subsequently follow, depending on user demand.

A main control circuit 16 is provided in the copier, where the main control circuit 16 includes central processing unit (CPU), a read only memory (ROM) and random access memory (RAM). Connected to the main control circuit 16 is a charge control circuit 17 for controlling a charging operation of the charger 2 and cleaning operation of a charging wire. Also connected is an exposing control circuit 18 for controlling the exposing operation, the surface voltage sensor 14 and the photo sensor 15, a human body sensor 21, as will be discussed and a timer 20. Control over when adjustment operations are performed during an image forming condition adjusting mode are controlled by the main control circuit 16.

The timer 20 keeps track of time (such as by counting clock cycles) and begins operation when a power source switch 19 is turned on. Alternatively, the timer 20 may continue to keep time in response to the occurrence of another predefined event. Further, the timer 20 terminates its counting operation and resets its accumulated counting value when the power source switch 19 is turned off. The timer 20 which starts and terminates its counting operation in response to the operation of the power source switch 19 is inexpensive in general.

The human body sensor 21 senses an object (e.g., an operator) that is in front of the copier. A detection signal produced by the human body sensor 21 may be employed to exert control over a condition control operation so that an operator will not be inconvenienced if the operator is about to begin to use the copier and the main control circuit 16 initiates the condition control adjustment operation.

The main control circuit 16 controls the copier such that the copier performs the following four operations when implementing the image forming condition adjusting mode.

a: The main control circuit 16 controls the copier such that the copier starts the image forming condition adjusting operation when the power source switch 19 is turned on or the timer 20 determines a predetermined amount of time has expired (relative to another event, such as when the switch 19 was turned on or since the last operation was performed, or an absolute time).

b: The main control circuit 16 judges whether the copier is presently performing an image forming operation when the timer 20 determines the predetermined period of time has expired. If so, the main control circuit 16 controls the copier such that the copier starts the image forming condition adjusting operation after the image forming operation has finished.

c: If the human body detector 21 detects the presence of an object near the copier (say near the front panel) when the timer 20 determines the predetermined period of time has expired, and the copier finishes the image forming operation, the copier does not start the image forming condition adjusting operation. When the human body detector 21 detects an absence of the object, the copier then starts the image forming condition adjusting operation.

d: The main control circuit 16 prohibits the formation of an image when image forming condition adjusting operation is being performed. When the image forming operation has been prohibited, a message that the copier is performing the image forming condition adjusting operation is indicated on the display of the operation panel.

In light of the above-mentioned operation, a more detail treatment of the control adjustment operation is now explained in more detail. The image forming condition adjusting operation is performed when the copier is in the following condition, namely conditions A and B, as discussed below.

Figure 2:
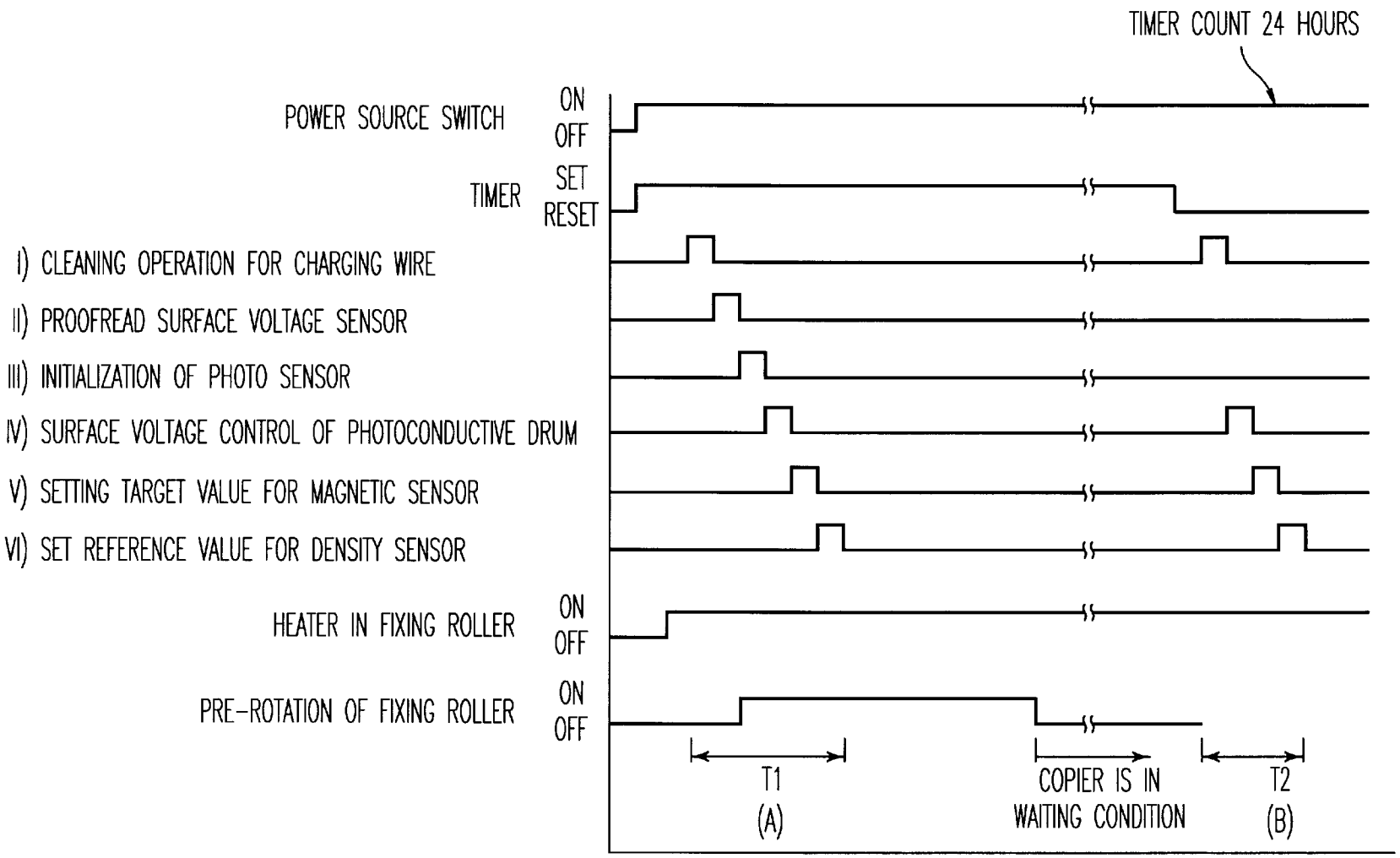
FIG. 2 is a timing diagram that identifies when respective image forming condition control operations are performed.

A: The power source switch 19 is turned on and the temperature of the fixing roller is not more than 100° C. In this case, after the power source switch 19 is turned on, a fixing device pre-rotating operation is performed. Moreover, a heater in the fixing roller is turned on and the fixing roller and the pressure roller rotate against one another until the temperature of the fixing roller rises to 180° C. as shown in FIG. 2. In response to turning on the power source switch 19, the main control circuit 16 outputs a command to processing devices such as the charger 2, the exposing unit 3, the developing device 5, the surface voltage sensor 14 and the photo sensor 15 to start the image forming condition adjusting operation. The image forming condition adjusting operation finishes before the pre-rotating operation finishes so that minimal operator time is wasted as part of a warm-up event.

B: The timer 20, which started the counting (e.g., time keeping) operation when the power source switch 19 was turned on, determines that a period of time that is 24 hours has expired. If the power source switch 19 has been turned on for a long time, for example 24 hours (or other period of time, or event occurrence), and the image forming condition adjusting operation has not been performed, the image quality is presumed to have become poor and is in need of an adjustment operation.

According to the present embodiment, if the timer 20 which starts its counting operation when the power source switch 19 is turned on, determines 24 hours has expired, the timer 20 outputs a signal to the main control circuit 16. Further, the human body detector 21 outputs a signal to the main control circuit 16 when it detects that an object is in front of the copier. The main control circuit 16 outputs a signal to the processing devices to start the image forming condition adjusting operation if the copier is in a waiting condition, namely the copier which does not start the image forming operation can start the image forming operation in response to a command to start the image forming operation, and the main control circuit 16 does not receive the signal from the human body detector 21. If the copier performs the image forming operation or the human detector 21 detects the presence of an object when the timer 20 determines 24 hours has expired, the main control circuit 16 delays the image forming condition adjusting operation until the image forming operation is finished and the human body detector detects the absence of the object.

In the image forming condition adjusting mode, the following adjusting operations are performed:

i) Cleaning Operation For Cleaning a Charging Wire Of Charger 2

In this operation, a charging wire cleaner is moved back and forth over the wire so as to scrape the adhesive matter off the wire.

ii) Proofread Surface Voltage Sensor 14

Predetermined bias voltages of −100 V and −800 V are supplied from a power source to develop bias voltages to a floating conductive core of the photoconductive drum 1, and output voltages corresponding to the input voltages are detected. A proofreading equation, which is relatively simplistic, determines a relationship between an input voltage to the surface voltage sensor 14 and an output voltage from the sensor 14 is determined by a relationship between the input voltages that are between −100 V and −800 V and the detected output voltages.

iii) Initialization Of Photo Sensor 15

An intensity of a light emitting diode of the photo sensor 15 is regulated such that the output of the photo sensor 15 reflected from the background of the photoconductive drum 1 becomes 4.0 V. The initialization is performed when the photoconductive drum 1 or the photo sensor 15 is replaced, by new ones, since a sensitivity of the photo sensor 15 or the reflecting ratio of the background of the photoconductive drum 1 changes if the photo sensor 15 or the photoconductive drum 1 is replaced by new ones.

iv) Surface Voltage Control Of Photoconductive Drum 1

Electrostatic latent images corresponding to the standard white plate 10*a* and the standard black plate 10 *b* are formed on the photoconductive drum 1, and the voltages corresponding to the latent images are detected by the surface voltage sensor 14. A grid voltage of the charger 2 and a lamp voltage of the exposing lamp are controlled such that each of the detected voltages reaches target voltages in order to compensate for a change in the surface voltage of the photoconductive drum 1 in response to device aging in the copier's ambient environment.

v) Setting Reference Value For Magnetic Permeability Sensor

If an image forming operation has not been performed for a long time, for example 24 hours, a quantity of charge of toner in the developing device 5 decreases. As a result, toner density which is detected by the photo sensor 15 increases even if toner density in the developing device 5 does not change, namely an output voltage from a magnetic permeability sensor which is provided in the developing device 5 does not change. Therefore, it is desirable to change a reference value Vref for the magnetic permeability sensor in response to the output value from the photo sensor 15.

vi) Setting Reference Value For Automatic Density Setting Sensor

A reference value to determine a developing bias voltage when an automatic density setting mode is selected is determined in response to the lamp voltage of the exposing lamp that are controlled in response to the detected surface voltage. When the automatic density setting mode is selected, an intensity of the reflected light from a background of the document is sensed, and then the developing bias voltage is controlled in response to the result of the comparison between the sensed value and the reference value.

When the power source switch 19 is turned on (Timing Sequence A), the image forming condition adjusting operations i) to vi) are performed in sequence during a period of time T1 as shown in FIG. 2. Note that the photoconductive drum 1, the surface voltage sensor 14 or the photo sensor 15 are usually replaced with replacement components after the power source switch 19 is turned off. Therefore, after the photoconductive drum 1, the surface voltage sensor 14 or the photo sensor 15 are replaced, the operations ii) and iii) are performed, but as will be seen, these operations are not performed in Timing Sequence B.

When the timer 20 counts 24 hours (Timing Sequence B) the image forming condition adjusting operations i) and iv) to vi) are performed during a period of time T2. Since the photoconductive drum 1, the surface voltage sensor 14 or the photo sensor 15 are not usually replaced when the power source switch 19 has been turned on, the operations ii) and iii) are not performed for Timing Sequence B. As a result, the time period T2 for performing the image forming condition adjusting operation at the timing sequence B is shorter than the time period T1 for the timing sequence A.

Figure 3:
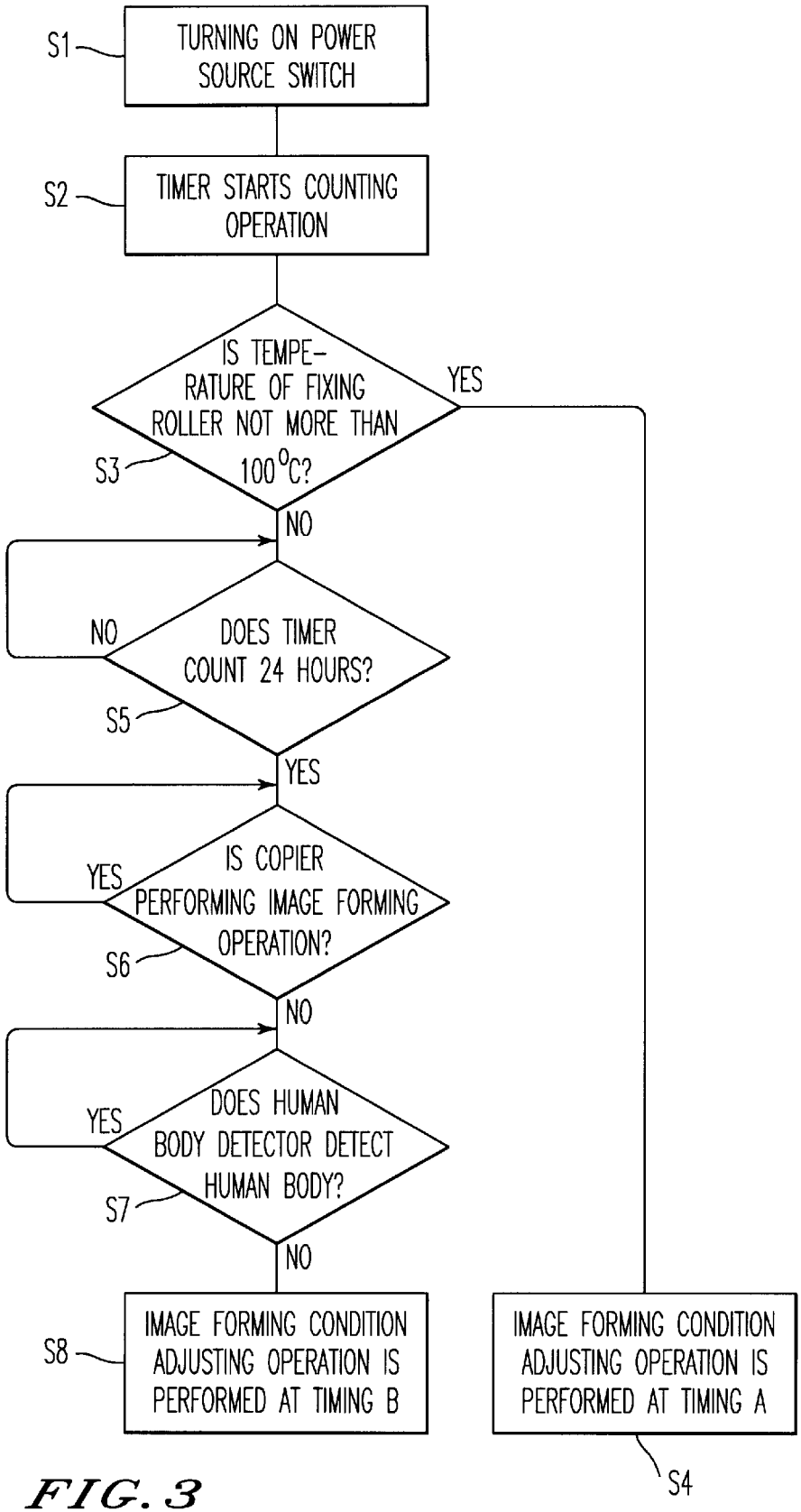
FIG. 3 is a flow sheet showing a control flow for performing the image forming condition adjusting operation.

FIG. 3 is a flowchart showing a condition for performing the image forming condition adjusting operation. The operation shown in FIG. 3 is controlled by the main control circuit 16 and begins in Step 1 when the power source switch 19 is turned on. Subsequently, the timer 20 starts its counting operation (Step 2). In response to turning on the power source switch 19, the heater in the fixing roller is turned on and the fixing roller and the pressure roller rotate. The main control circuit 16 judges whether the temperature of the fixing roller is not more than 100° c. (Step 3). If the temperature of the fixing roller is not more than 100° c., the image forming condition adjusting operations i) to vi) corresponding to the timing sequence A is performed (Step 4). The image forming condition adjusting operation corresponding to the timing sequence A is finished after the temperature of the fixing roller reaches 180° c. After the image forming condition adjusting operation is finished and the temperature of the fixing roller reaches 180° c., the copier enters a waiting mode of operation. In the waiting mode, the copier can start the image forming operation if the starting command is inputted into the main control circuit 16.

The main control circuit 16 checks the timer 20 whether the timer determines whether 24 hours has expired, or not, until the main control circuit 16 resets the timer 20 by turning off the power source switch 19 (Step 5). When the timer 20 counts 24 hours and the main control circuit 16 receives a time up signal from the timer 20, the main control circuit 16 judges whether the copier is performing the image forming operation (Step 6). If the copier is performing the image forming operation, the main control circuit 16 does not output a command to start the image forming condition adjusting operation until the image forming operation is finished. Thus, the copier continues the image forming operation.

The main control circuit 16 keeps watch on the condition of the copier. When the main control circuit 16 judges that the image forming operation is finished, the main control circuit 16 judges whether the human body detector 21 detects the presence of the object (Step 7). If the copier is in the waiting condition when the timer 20 counts 24 hours, the main control circuit 16 also judges whether the human body detector 21 detects the presence of the object (Step 7). When the human body detector 21 has detected the object, there is a possibility that the image forming operation may soon begin by the operator initiating a copy command. Therefore, if the main control circuit 20 judges that the human body detector 21 detects the object, the main control circuit 16 does not output a command to start the image forming condition adjusting operation (Step 7). If the main control circuit 16 judges that the copier does not perform the image forming operation and the human body detector 21 does not detect the object, the main control circuit 16 outputs a command to start the image forming condition adjusting operations i) and iv) to vi) (Step 8).

When the image forming condition adjusting operation is performing the timing sequence B, the main control circuit 16 prohibits the image forming operation of the copier. The main control circuit 16 also controls the operation panel to indicate the following message: "Image Forming Condition Adjusting Operation Is Performed. Please Wait For One Minute." Therefore, the operator can find that the operator can not use the copier and the reason why the operator can not use the copier.

The processes set forth in the present description may be implemented using a conventional general purpose microprocessor programmed according to the teachings of the present specification, as will be appreciated to those skilled in the relevant art(s). Appropriate software coding can readily be prepared by skilled programmers based on the teachings of the present disclosure, as will also be apparent to those skilled in the relevant art(s).

The present invention thus also includes a computer-based product which may be hosted on a storage medium and include instructions which can be used to program a computer to perform a process in accordance with the present invention. The storage medium can include, but is not limited to, any type of disk including floppy disk, optical disk, CD-ROMS, and magneto-optical disks, ROMS, RAMs, EPROMs, EEPROMs, flash memory, magnetic or optical cards, or any type of media suitable for storing electronic instructions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus having a plurality of controllable processing devices that cooperate to form an image on an image holding member, comprising:

a controllable power source configured to supply electric power to said apparatus when said power source is turned on;

a timer configured to keep track of time based on when said power source is turned on; and a control circuit configured to control an adjustment operation of a condition of at least one of said processing devices, said adjustment operation starting either when said power source is turned on or when said timer determines a predetermined amount of time has expired.

2. An apparatus as claimed in claim 1, further comprising a fixing device for fixing a toner image on said image holding member when said fixing device reaches a fixing temperature.

3. An apparatus as claimed in claim 2, wherein said control circuit controls the adjustment operation to start when said power source is turned on and temperature of said fixing device is not more than a predetermined temperature below said fixing temperature.

4. An apparatus as claimed in claim 1, wherein said control circuit judges whether the image forming apparatus is presently performing an image forming operation when said timer determines the predetermined amount of time has expired.

5. An apparatus as claimed in claim 4, wherein if said control circuit judges that said image forming apparatus is performing the image forming operation, the control circuit delays the adjustment operation until the image forming operation is finished.

6. An apparatus as claimed in claim 1, further comprising a human body detector configured to detect a presence or absence of a human body in front of said image forming apparatus when said timer counts the predetermined value.

7. An apparatus as claimed in claim 6, wherein if said human body detector detects the human body and communicates a detection signal to said control circuit, the control circuit delays the adjustment operation until said human body detector detects the absence of the human body.

8. An apparatus as claimed in claim 1, wherein said control circuit is configured to control said processing devices so that when the adjustment operation is being performed, an image forming operation is prohibited from also being performed.

9. An apparatus as claimed in claim 8, further comprising an operation panel which indicates that the adjustment has been performed.

10. An apparatus as claimed in claim 1, wherein the adjustment operation includes at least one of, a cleaning a charging wire operation, a proofreading a surface voltage sensor operation, an initializing a photo sensor operation, an adjusting of at least one of said processing devices for controlling a surface voltage of a photoconductive member operation, a setting reference value for a magnetic permeability sensor operation, and a setting reference value operation for an automatic density setting sensor.

11. An apparatus as claimed in claim 10, wherein a number of adjustment operations performed when said timer determines said predetermined time expires is fewer than that performed when said power source is turned on.

12. An apparatus as claimed in claim 11, wherein the adjustment operation excludes includes at least one of the proofreading a surface voltage sensor operation, and the initializing a photo sensor operation.

13. An image forming apparatus having a plurality of controllable processing devices that cooperate to form an image on an image holding member, comprising:

means for supplying electric power to said apparatus when a power source switch is turned on;

means for counting time in response to turning on said power source; and means for controlling an adjustment condition of at least one of said processing devices such that said adjustment starts when said power source is turned on or said timer determines a predetermined time has expired.

14. An apparatus as claimed in claim 13, further comprising means for fixing a toner image on said image holding member when said fixing means reaches a fixing temperature.

15. An apparatus as claimed in claim 14, wherein said means for controlling controls the adjustment of the condition of at least one of said processing devices such that said adjustment starts when said supplying means is turned on and a temperature of said means for fixing is not more than a predetermined temperature below said fixing temperature.

16. An apparatus as claimed in claim 13, wherein said means for controlling judges whether the image forming apparatus is presently performing an image forming operation when said means for counting time determines said predetermined amount of time has expired.

17. An apparatus as claimed in claim 16, wherein if said means for controlling judges that said image forming apparatus is performing the image forming operation, the adjustment operation is delayed until the image forming operation is finished.

18. An apparatus as claimed in claim 13, further comprising means for detecting a presence or absence of a human body in front of said image forming apparatus when said means for counting time determines said predetermined amount of time has expired.

19. An apparatus as claimed in claim 18, wherein if said means for detecting detects the presence of the human body, the adjustment is delayed until said means for detecting detects the absence of the human body.

20. An apparatus as claimed in claim 13, wherein said means for controlling controls said processing devices such that when the adjustment is being performed, an image forming operation is prohibited.

21. An apparatus as claimed in claim 20, further comprising means for indicating a condition that the adjustment operation is being performed.

22. A method for controlling an operation of an image forming apparatus, comprising the steps of:

supplying electric power to said apparatus when a power source switch is turned on;

counting time in response to turning on said power source; and controlling an adjustment operation of a condition of at least one of a plurality of processing devices such that said adjustment operation starts when said power source is turned on or said timer counts a predetermined count value.

* * * * *